United States Patent [19]

Koivula et al.

[11] Patent Number: 4,968,218

[45] Date of Patent: Nov. 6, 1990

[54] METHOD OF CONTROLLING THE AIR OUTPUT OF A SCREW COMPRESSOR

[75] Inventors: Jorma Koivula; Timo Halkola; Reijo Nurminen, all of Tampere, Finland

[73] Assignee: Oy Tampella AB, Tampere, Finland

[21] Appl. No.: 412,102

[22] Filed: Sep. 25, 1989

[30] Foreign Application Priority Data

Oct. 5, 1988 [FI] Finland ..... 884573

[51] Int. Cl.[5] ..... F04C 29/10

[52] U.S. Cl. ..... 417/19; 417/26; 417/28; 417/53; 417/295

[58] Field of Search ..... 417/19, 26, 28, 295, 417/316, 317, 53

[56] References Cited

U.S. PATENT DOCUMENTS

| | | | |
|---|---|---|---|
| 3,119,552 | 1/1964 | Thomann | 417/19 |
| 3,860,363 | 1/1975 | Silvern et al. | 417/26 |
| 4,201,517 | 5/1980 | Ferguson | 417/26 |
| 4,642,033 | 2/1987 | Boller | 417/295 |

OTHER PUBLICATIONS

Kompressorikirja, Airila, 1983, pp. 40–45 (no English lauguage translation).

English Language Abstract of Airila, M., "Analytical Research into Throttling Controlling Methods . . . ", 1980.

English Abstract, Airila, M., "Screw Compressors and Compressed Air Receivers . . . ", 1981.

*Primary Examiner*—Leonard E. Smith
*Assistant Examiner*—David W. Scheuermann
*Attorney, Agent, or Firm*—Nixon & Vanderhye

[57] ABSTRACT

A method of controlling the air output of a screw compressor, wherein the average air output of the compressor during operation is adapted to air consumption by throttling the flow of suction air or by connecting the compressor alternately to full air output capacity and idle operation capacity. In order to reduce the power consumption of the compressor, the air output is controlled first by throttling the flow of suction air and by simultaneously measuring underpressure in the suction conduit of the compressor. Thereafter the compressor is controlled so as to operate alternately at full air output capacity and idle operation capacity, and the pressure rise rate in the air-pressure network is measured when the compressor operates at full output capacity and the pressure fall rate is measured when the compressor operates at idle operation capacity. The air consumption and the power consumption of the compressor with both ways of control at this particular air consumption level are calculated on the basis of the values so measured. Thereafter the compressor is connected to apply the control with the smaller power consumption.

5 Claims, 1 Drawing Sheet

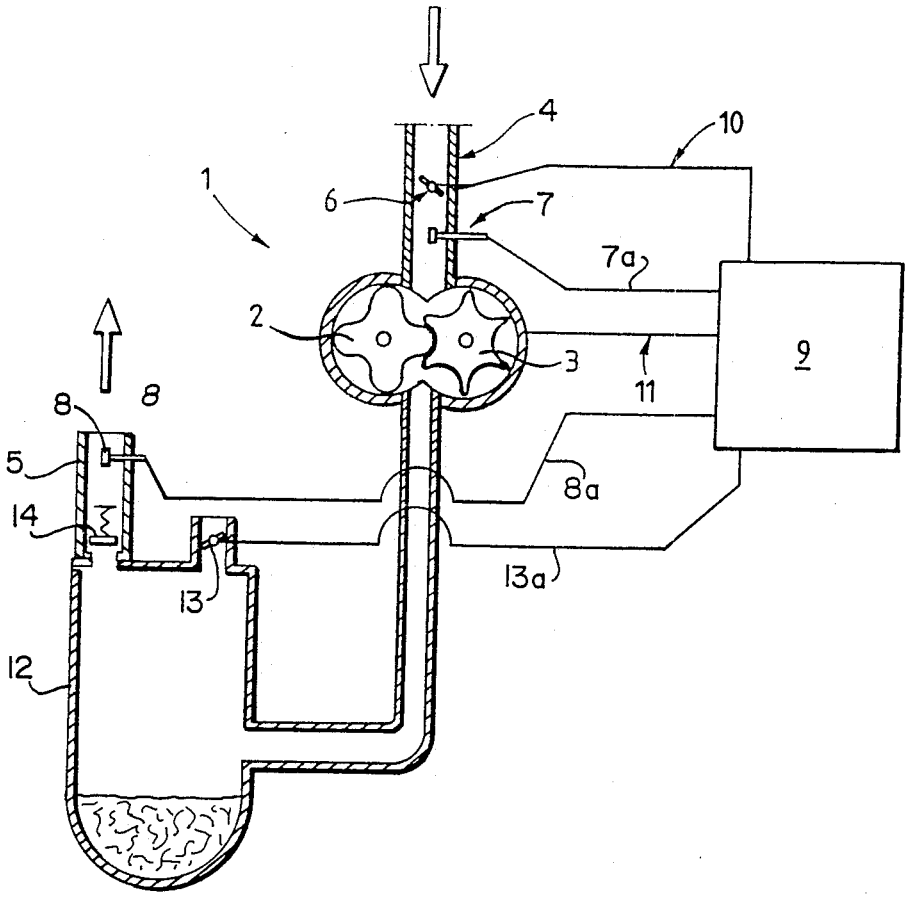
4
10
1
6
7
7a
2
3
9
11
8
8
5
8a
14
13
13a
12

METHOD OF CONTROLLING THE AIR OUTPUT OF A SCREW COMPRESSOR

The invention relates to a method of controling the air output of a screw compressor, wherein the average air output of the compressor during operation is adapted to air consumption by throttling the flow of suction air or by connecting the compressor alternately to full air output capacity and idle operation capacity.

Screw compressors are used widely to supply compressed air into various air-pressure networks to which tools and devices of different kinds are connected. When the compressor operates at full capacity, the amount of air supplied by the compressor is usually greater than that exhausted from the network through the tools and devices, wherefore the air output of the compressor has to be controlled. Widely used control techniques include two-point control, throttle control and stop control.

In two-point control, an upper and a lower pressure limit value are defined for the air-pressure network by pressure switches. When the compressor is started, a suction valve in its suction conduit is fully open and the compressor operates at full air output capacity until the preset upper pressure limit value is obtained. Then the pressure switch closes the suction valve, opening an exhaust valve of an oil separator tank for emptying it. With this mode of operation, the power demand of the compressor is about 12 to 20% of that required for attaining full air output. When the pressure drops to the preset lower limit value, the suction valve is opened wide open by the pressure switch responsive to the lower limit value, and the compressor operates again at full air output capacity.

In throttle control, the compressor operates continuously and the suction valve of the compressor is controlled by the pressure switch in such a way that the amount of air supplied to the network by the compressor corresponds to the consumption of compressed air. If there is no consumption of air, and the suction valve is closed by the throttle control, the power demand of the compressor is about 70% of that required for full air output.

In stop control, the compressor is started at the lower pressure limit value of the network, and it operates until the upper pressure limit value is achieved, whereafter the compressor is switched off by the pressure switch responsive to the upper limit value.

These control techniques are often applied in one and the same compressor in such a way that the throttle control is applied when the consumption of air is high and the pressure in the network tends to drop, and when the consumption decreases and the pressure in the network exceeds the preset upper limit value, the pressure switch causes the compressor to operate at idle. Correspondingly, when the pressure drops to the preset lower limit value, the compressor is caused to operate at full capacity, whereafter the suction air flow is again begun to be throttled when the consumption decreases. The control may further comprise a time function so that the compressor is stopped after having operated at idle for a preset period of time until the pressure in the network drops to a preset lower limit value, whereby the pressure switch starts the compressor, causing it to operate immediately at full air output capacity.

The operation of the compressor is affected, among other things, by the operating conditions, such as the nominal output of the compressor relative to air consumption, the network volume, the presence of a storage air tank possibly provided in the network, variation in consumption, and other compressors possibly connected to the network. As is known, the shift from one mode of operation to another in solutions presently in use takes place solely on the basis of the preset pressure value of the pressure switch, whereas the above-mentioned operating conditions are totally ignored. As a result, the overall operation of the compressor is uneconomical; its power consumption is unnecessarily high. This could be avoided if a control best suited for the purpose could be used in each operational situation.

The object of the present invention is to provide a method of controlling the air output of a screw compressor by taking into account the operating conditions and by optimizing the control in view of the operating conditions in such a way that the power consumption is minimized. This is achieved according to the invention by first controlling the air output by throttling the suction air flow; simultaneously measuring underpressure in the suction conduit of the compressor; subsequently controlling the compressor so as to operate alternately at full air output capacity and at idle operation capacity; measuring the rate of pressure rise in the air-pressure network when the compressor operates at full output capacity and the rate of pressure fall when the compressor operates at idle operation capacity; calculating, on the basis of the values so measured, the air consumption and the power consumption of the compressor with each control technique on this particular air consumption level; and connecting the compressor so as to apply the control technique with the lower power consumption.

The invention is based on the measurement of the air consumption and properties of the network, that is, the capacity of the network to store air and maintain pressure. The requisite amount of air at the measuring moment can be calculated on the basis of these measurements; correspondingly, it can be determined on the basis of the power demand of the compressor with each control technique which one of the control techniques is worth using. An advantage of the solution according to the invention is that the power consumption of the compressor can be minimized in view of the operating conditions, thus achieving savings in costs and avoiding unnecessary starts and stops and other major changes in the control procedures, which increases the service life of the compressor and improves the operational reliability.

The invention will be described in greater detail with reference to the attached drawing, which shows a schematical view of a screw compressor provided with a control device for applying the method.

The figure shows schematically a screw compressor 1 within which there are provided compression screws 2 and 3. The compressor comprises a suction conduit 4 and an inlet conduit 5 connected to an air-pressure network. The suction conduit 4 comprises a throttle 6 for throttling it. Furthermore, the suction conduit 4 comprises a pressure gauge 7 for measuring the underpressure prevailing in the suction conduit as compared with atmospheric pressure. The inlet conduit 5, in turn, comprises a pressure gauge 8 for measuring pressure in the air-pressure network. The pressure gauge 7 of the suction conduit and the pressure gauge 8 of the inlet conduit are connected to a control device 9 which measures pressure in both conduits. The control device 9 is further arranged to control the throttle 6 through a control conduit 10 and to start or switch off the compressor 1 by means of a control conduit 11.

Pressurized air from the screw compressor 1 flows into a conventional oil separator tank 12. Oil is separated at the bottom of the tank 12, which is provided with an exhaust valve 13 connected to the control device 9 with a control channel 13A. In the air exhaust channel 5 extending from the top of the tank 12 a non-return valve 14 is provided enclosing the air exhaust channel 12 when the air feed from the compressor stops, thereby preventing the pressure from discharging from the air feed network into the pressure tank 12 and onwards into the open air through the exhaust valve 13 when it is opened. Line 8*a* extends between sensor 8 and control 9, and line 7*a* between sensor 7 and control 9.

At the start-up of the compressor 1, the control device 9 causes the suction valve 6 to open completely so that the compressor 1 sucks air through the suction conduit 4 substantially without underpressure and supplies it through the inlet conduit 5 into the air-pressure network. When the pressure in the air-pressure network rises to a preset pressure value, usually a lower limit value determined for the network, the pressure gauge 8 applies a control signal to the control device 9, which begins to close the throttle 6 until the pressure remains at the preset value, that is, the amount of air fed by the compressor 1 is equal to that consumed by tools and other devices in the network. In this situation, the control device 9 records the underpressure measured by the pressure gauge 7 of the suction conduit in comparison with atmospheric pressure, on the basis of which it calculates the air consumption of the network. Thereafter the control device 9 shifts the compressor to the two-point control, whereby the throttle 6 is opened wide open and the pressure in the network starts to rise. From the moment when the compressor is shifted to the two-point control, the control device 9 starts to measure the time required for the pressure in the air-pressure network to rise to the preset upper limit value, which is measured by the pressure gauge 8, whereafter the control device 9 closes off the throttle, i.e., the suction valve 6, and measures again the fall time, that is, the time required for the pressure in the network to drop from the allowed upper limit value to the lower limit value. On the basis of the values thus measured and the power consumption properties of the compressor 1, a microprocessor provided in the control device calculates which one of the control techniques consumes less power at the prevailing load. This control technique is then applied until the operating conditions change. In order to be able to utilize the right control technique as efficiently as possible, the measurement is repeated at predetermined intervals so that the control can be changed when conditions change.

In a preferred embodiment of the invention, the microprocessor calculates on the basis of the properties of the network the air consumption level on which the power demand of both controls is substantially equal. The control device then calculates the air consumption and when the air consumption exceeds the value calculated as described above, the throttle control is begun to be applied. When the air consumption drops below said value, the compressor is shifted to the two-point control. Thereby the control device switches on the throttle control at predetermined intervals and measures again the value descriptive of the operating conditions as described above, causing the compressor to operate in the most efficient way in terms of power consumption.

When the compressor is controlled by the two-point control, the control device 9 may also measure the idle operation time. When the idle operation time exceeds a predetermined length of time, the control device 9 switches off the compressor, because air consumption in the network is thereby so low that the average power consumption is at lowest when the machine is stopped intermittently. During normal consumption of air, the control device, however, mainly utilizes the throttle control and the two-point control according to the principle described above.

We claim:

1. A method of controlling the air output of a screw compressor, in which method the average air output of the compressor during operation is adopted to air consumption by throttling the flow of suction air or by connecting the compressor alternately to full air output capacity and idle operation capacity, said method comprising the steps of first controlling the air output by throttling the suction air flow and simultaneously measuring underpressure in the suction conduit of the compressor; subsequently controlling the compressor so as to operate alternately at full air output capacity and at idle operation capacity; measuring the rate of pressure rise in the air-pressure network when the compressor operates at full output capacity and the rate of pressure fall when the compressor operates at idle operation capacity; calculating, on the basis of the values so measured, the air consumption and the power consumption of the compressor with each control technique at this particular air consumption level; and connecting the compressor so as to apply the control technique with the lower power consumption.

2. A method according to claim 1, wherein an air consumption limit value at which the air consumption is equal with both control techniques is calculated on the basis of the values measured, whereby the air output of the compressor at an air consumption level above the limit value is controlled by throttling the flow of suction air and at an air consumption level below the limit value the air output of the compressor is controlled by alternately switching on full air output capacity and idle operation capacity.

3. A method according to claim 1 wherein said underpressure, said pressure rise rate and said pressure fall rate are measured and the values on the basis of which the choice of control is made are calculated at predetermined intervals.

4. A method according to claim 1 wherein said pressure rise rate and said pressure fall rate are determined by measuring the time required for the pressure to rise from a preset lower limit value to a preset upper limit value and to fall from said upper limit value to said lower limit value.

5. A method according to claim 1 wherein the compressor is stopped when the air consumption level drops below a predetermined lower limit value, the compressor being restarted only when the pressure drops to said lower limit value.

* * * * *